United States Patent [19]

Eaton et al.

[11] Patent Number: 4,595,637

[45] Date of Patent: Jun. 17, 1986

[54] PLASMA COATINGS COMPRISED OF SPRAYED FIBERS

[75] Inventors: Harry E. Eaton, Woodstock; Richard C. Novak, Glastonbury, both of Conn.

[73] Assignee: United Technologies Corporation, Hartford, Conn.

[21] Appl. No.: 544,668

[22] Filed: Oct. 24, 1983

Related U.S. Application Data

[63] Continuation of Ser. No. 322,132, Nov. 17, 1981, abandoned.

[51] Int. Cl.[4] ..... B32B 7/00; B32B 15/14

[52] U.S. Cl. ..... 428/608; 428/621; 428/937

[58] Field of Search ..... 428/608, 627, 629, 632, 428/633, 678, 679, 680, 613, 937, 621

[56] References Cited

U.S. PATENT DOCUMENTS

| | | | |
|---|---|---|---|
| 3,233,697 | 2/1966 | Slayter et al. | 181/42 |
| 3,427,185 | 2/1969 | Cheatham et al. | 428/937 |
| 3,519,282 | 7/1970 | Davis | 277/230 |
| 3,723,165 | 3/1973 | Longo et al. | 427/423 |
| 3,975,165 | 8/1976 | Elbert et al. | 29/182.2 |
| 4,075,364 | 2/1978 | Panzera | 427/34 |
| 4,141,802 | 2/1979 | Duparque et al. | 204/15 |
| 4,209,334 | 6/1980 | Panzera | 427/34 |
| 4,269,903 | 5/1981 | Clingman et al. | 428/471 |
| 4,273,824 | 6/1981 | McComas et al. | 428/937 |
| 4,336,276 | 6/1982 | Bill et al. | 427/34 |
| 4,338,380 | 7/1982 | Erickson et al. | 428/608 |

FOREIGN PATENT DOCUMENTS

| | | |
|---|---|---|
| 2113177 | 9/1972 | Fed. Rep. of Germany . |
| 1434948 | 3/1966 | France . |
| 821690 | 10/1959 | United Kingdom . |

*Primary Examiner*—L. Dewayne Rutledge
*Assistant Examiner*—John J. Zimmerman
*Attorney, Agent, or Firm*—C. G. Nessler

[57] ABSTRACT

Disclosed is a process for plasma spraying small metal fibers, to adhere them to the surface of a workpiece, and articles made using the process. The process is especially useful for improving the strength of plasma arc coatings, as well as for improving the bonding of plasma arc coatings to substrates. To make an improved ceramic faced metal article, fibers are sprayed onto the workpiece by injecting fibers into the plasma stream external to the plasma gun nozzle. Then, plasma sprayed ceramic particles are caused to surround the fibers as a matrix. The optional interposition of a removable polymer material on the workpiece surface, after the fibers are sprayed but before the ceramic matrix is sprayed, provides an effective way of providing a low stiffness connector between a low thermal expansion coefficient ceramic material and a high expansion coefficient metal substrate. The connector alleviates strains from thermal expansion differences.

21 Claims, 7 Drawing Figures

PLASMA COATINGS COMPRISED OF SPRAYED FIBERS

This application is a continuation of application Ser. No. 322,132, filed Nov. 17, 1981 and now abandoned.

TECHNICAL FIELD

The present invention relates to plasma spraying and plasma sprayed coatings, most particularly those which contain fibers.

BACKGROUND

In the last two decades there has been extensive development of plasma arc spraying and many applications have been developed. Plasma spraying offers the ability to create coatings and free standing structures of virtually any material which can be melted.

Of particular interest has been the adhering of ceramic surfaces to metal elements, to protect them from thermal and abrasive environments. As is well known, substantial problems of incorporating ceramic material with metal structures arise from the differences in thermal expansion which exist between most ceramics and most metals. High temperature structures generally utilize high temperature metals, such as superalloys of iron, nickel, and cobalt. These materials characteristically have high thermal expansion coefficients of the order of $10\text{–}14\times10^{-6}$ per °C. The ceramics which are of most interest tend to be those containing alumina, zirconia, magnesia, and like materials which have low thermal expansion coefficients, of the order of $5\text{–}10\times10^{-6}$ per °C.

Several different approaches have been utilized to obtain good adhesion between a low expansion ceramic structure and a high expansion metal structure. One approach has been to form sprayed composite interlayers by mixing metal and ceramic powders to provide a gradation in composition, starting with entirely metal powder at metal surface, progressing through partial metal and partial ceramic, and ending with entirely ceramic. Still another method described in U. S. Pat. No. 4,273,824 of McComas et al., having common assignee herewith, has been to first adhere a fiber metal mat to a metal surface, by brazing or diffusion bonding. Plasma spraying is used to build up a coating of ceramic on the fiber mat. To improve bonding of the ceramic to the fiber mat, a thin bond coating of a metal has been first sprayed on the mat. While sucess has been met with these approaches, there are still improvements needed for lower cost and improved performance.

Plasma spray coatings and free standing plasma sprayed structures, particularly when they are accreted to relatively great thicknesses, tend to be materials which have relatively low strength compared to materials which have been formed by other methods. Thus, it is desirable to find convenient ways to include fibers within a built up plasma sprayed structure since fibers will enhance their strengths. Boron fiber reinforced aluminum composites are one known combination of fibers with plasma coatings. They are made by laying fibers on thin metal foils and spraying with aluminum to bond the fibers to the foil, to form laminae. Subsequently, many such fiber-foil laminae are pressed together to form generally thin and wide articles, such as airfoils. But the process is costly. Also, there is no feasible way of incorporating fibers transverse to the nominal plane of the articles, owing to the mode of construction from laminae.

SUMMARY OF THE INVENTION

An object of the invention is to provide a technique for plasma spraying fibers onto a surface. A further object is to form plasma coatings and other coatings having fibers as an integral part thereof.

According to the invention, fibers are partially melted and adhered to one another when they are deposited on a workpiece surface using a thermal spray process, such as plasma spraying. In the principle embodiment of the invention, the fibers are adhered to the workpiece surface, as well. The surface is optionally made more receptive by the use of a preliminary bond coating. The deposited fibers may be caused to have a random pattern or a more normally aligned pattern, according to the fiber aspect ratios and the spraying parameters which are used. In both instances, a substantial portion of the fibers project from the surface, as opposed to aligning generally parallel to it. During spraying, only portions of the fibers are melted. Most of a typical sprayed fiber remains intact, but partial melting, of the ends and exterior surface, causes desirable bonds with the workpiece and between the fibers themselves. To obtain the foregoing results, the fibers are injected into the hot plasma gas stream at a point between the plasma generating nozzle and the workpiece.

Matrix material can be infiltrated among the fibers, after they are deposited on the workpiece surface. The matrix may be applied by a variety of techniques, but the invention will be found principally useful when the matrix is comprised of a layered plasma sprayed coating. The fibers aid in holding the plasma sprayed matrix onto the substrate. In addition, by projecting through the layers of the sprayed matrix, the invention provides greater strength to the matrix. When the matrix material is a plasma sprayed coating, a bonding coat may be deposited on the fibers, before the principal matrix material is applied.

The invention is particularly suitable for forming a metal-ceramic airseal for a gas turbine engine. In such instances, preferably the substrate is a superalloy and the matrix material is a zirconia base ceramic material; the fibers are a metal having high temperature strength and corrosion resistance. This embodiment is further improved by the following practice of the invention: After the fibers have been deposited, but before the matrix is deposited, a fugitive material, such as a polymer, is placed on the substrate so that it fully envelopes a portion of the fibers on the workpiece. But the fiber portions which project furthest from the workpiece are not fully enveloped by the polymer. Thus, when the matrix material is subsequently sprayed, it envelopes the projecting ends of the fibers. Then, the fugitive polymer material is removed, such as by combustion. This leaves a ceramic and metal fiber composite structure joined to the substrate surface by a network of metal fibers which are not embedded in the matrix material. This network of metal fibers has relatively good structural compliance. That is, it is adapted to deform with relatively low resistance, to accommodate differences in thermal expansion between the ceramic and the metal substrate. Thus, the ceramic is held closely to the substrate, but is not subject to damaging strains.

Generally, the inclusion of fibers in coatings will increase strength or other properties, such as thermal conductivity. The invention is felt useful with all manner coatings, in addition to plasma coatings. The fibers may be of any material which may be plasma sprayed. Fibers alone, without any matrix material, will be useful when adhered to a substrate to increase its surface area.

The foregoing and other objects, features and advantages of the present invention will become more apparent from the following description of preferred embodiments and accompanying drawings.

BEST MODE FOR CARRYING OUT THE INVENTION

The invention is described in terms of the application of a zirconia ceramic coating to a stainless steel substrate using stainless steel fibers. However, it will be seen that the invention is equally applicable to other material combinations.

Figure 1:
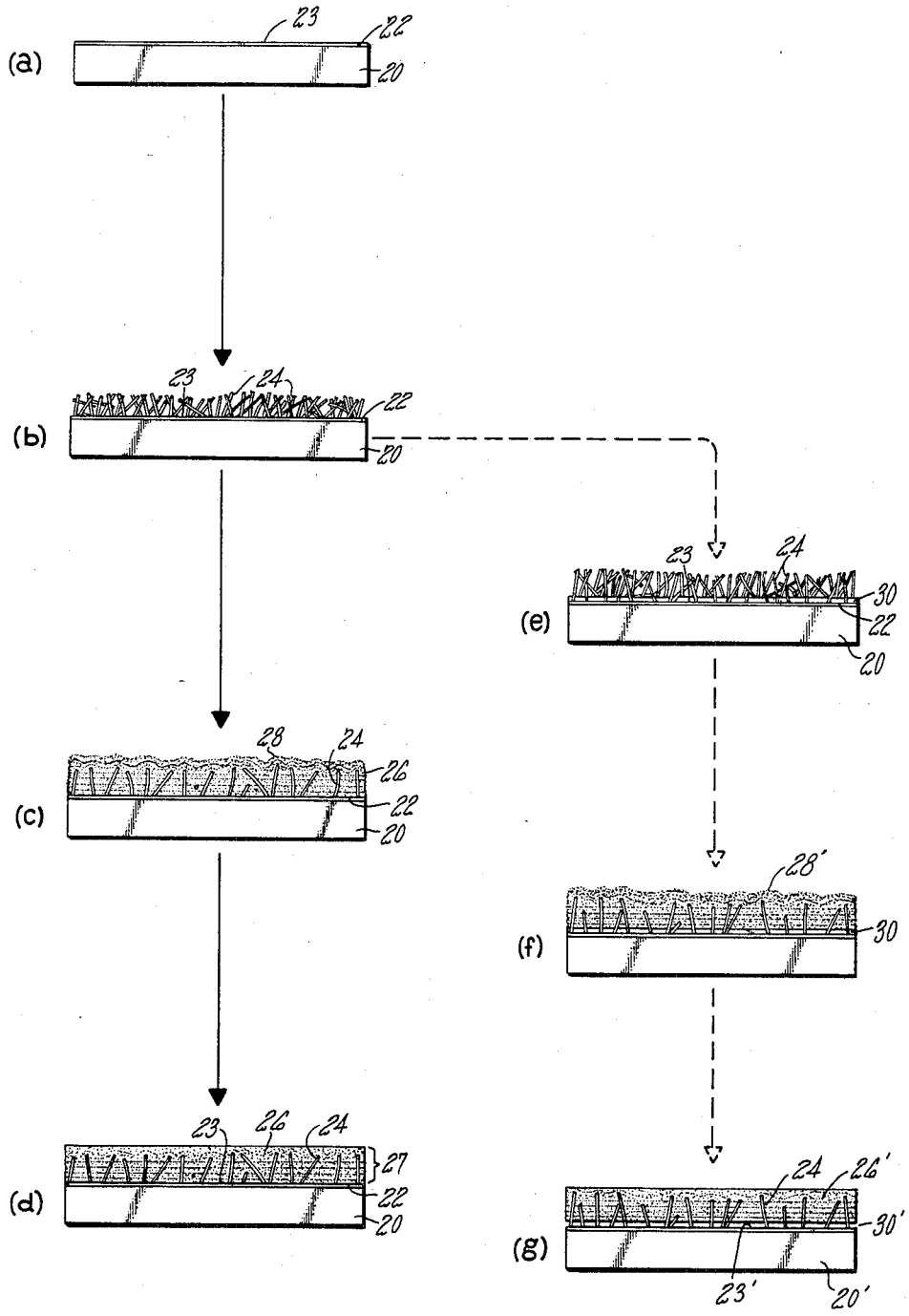
FIG. 1 illustrates the steps in forming certain inventive articles, by end views of a substrate.

FIG. 1 illustrates generally the preferred steps in the invention. A bond coat 22 is first plasma sprayed onto the clean surface of a metal substrate or workpiece 20, as shown in FIG. 1(*a*), to provide a particularly receptive surface 23 for the later deposited materials. Next, fine metal fibers 24 are plasma sprayed so they adhere to the bond coated workpiece surface. As illustrated by FIG. 1(*b*), many of the fibers will project above the surface of the workpiece. The next step is to plasma spray powders to form a typical layered ceramic structure 26, which will envelope the projecting fibers, as shown in FIG. 1(*c*). Prior to this step it may be preferred to plasma spray a light bond coat of metal powder onto the adhered fibers, although generally we have not found this necessary. Because of the uneven surface of the fibers, the deposited ceramic surface will be uneven. Thus, an optional next step, is to remove protuberances 28 from the surface of the ceramic, as by grinding, to provide a smooth finish. The resultant article 27, seen in FIG. 1(*d*), is comprised of a substrate 20 with a fiber and ceramic matrix coating 27 adhered to its surface 23.

An optional procedure, illustrated by FIGS. 1(*e*)–(*g*) is to produce an article where the ceramic matrix-fiber composite material is separated from the substrate, by a compliant low stiffness structure of fibers. As illustrated by FIG. 1(*e*), a polymer layer 30 is plasma or otherwise sprayed onto the workpiece surface 23, so that it envelopes a portion of the fibers which project from the surface. The thickness of the layer 30 is chosen so that portions of the projecting fibers 24 protrude above the mean surface of the layer. Then, the ceramic matrix material is sprayed onto the polymer layer, as illustrated by FIG. 1(*f*), using a procedure analogous to that which resulted in the structure shown in FIG. 1(*c*). The layered ceramic material 26' will adhere to the polymer surface and envelope the portions of the fiber which protrude above the polymer. Next, the surface 28' of ceramic is optionally ground to produce a smooth and even finish. Then the article is placed in a furnace having an oxidizing atmosphere to cause the polymer to combust, converting it to a gas which is carried away. This leaves the article illustrated in FIG. 1(*g*) wherein the fiber and ceramic matrix structure 26' is spaced apart from the bond coated surface 23' of the substrate, but it is joined to it by many fibers. Thus, the polymer has functioned as a fugitive material, to temporarily bar the infiltration of ceramic materials into the said space. When its function has been fulfilled, it has been removed without adverse effect on the workpiece or coating. It is seen that the coating on the substrate can be characterized as having a first portion 26' comprised of fiber reinforced ceramic matrix, and second portion 30' comprised of fibers substantially free of matrix particles.

Figure 2:
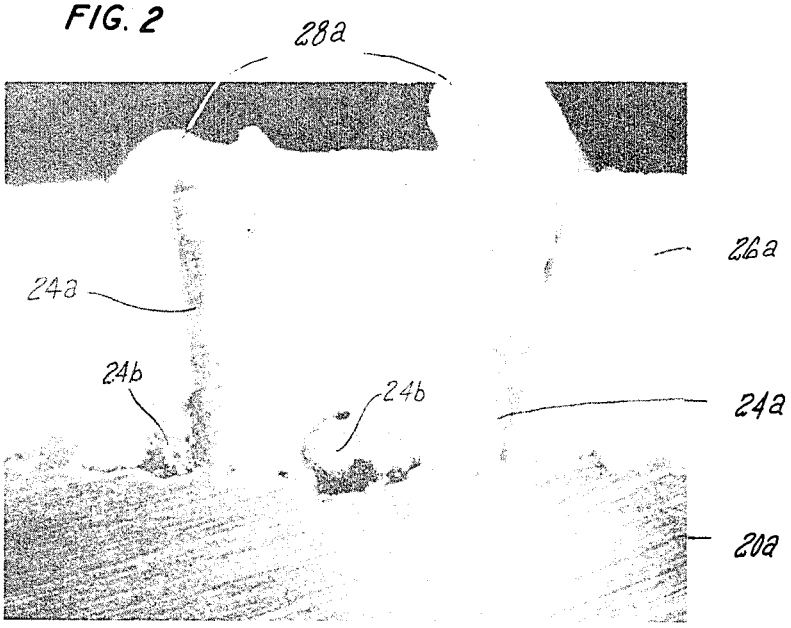
FIG. 2 shows in a cross section a ceramic matrix surrounding metal fibers, both on a metal substrate.
Figure 3:
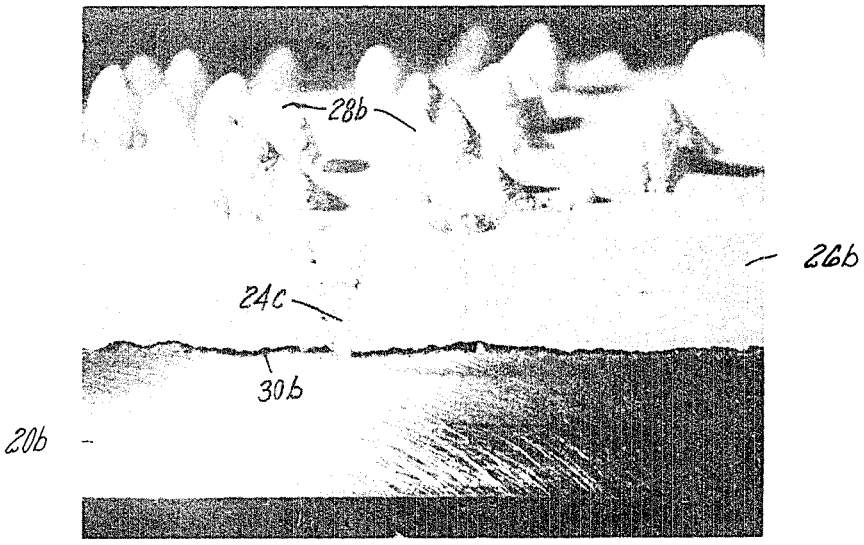
FIG. 3 is similar to FIG. 2, but the specimen has a purposeful gap between the ceramic and the substrate.

FIG. 2 shows in cross section an actual article corresponding to FIG. 1(*c*) comprised of fibers 24*a*, 24*b* of stainless steel, a substrate 20*a* also of stainless steel, and a matrix 26*a* of predominately zirconia. The matrix is about 2.5 mm thick. Nominally normal fibers 24*a* are seen in combination with portions of fibers 24*b* which are either parallel or inclined to the workpiece. Protuberances 28*a* are caused by plasma build up on the fibers. FIG. 3 shows in perspective and cross section an analogous specimen corresponding with FIG. 1(*g*), except the ceraxic surface protuberances 28*b* have not been removed. Between the composite structure of matrix 26*b* and fibers is a space 30*b* about 0.1 mm wide created by polymer which has been removed. A fiber 24*c* crossing the space and holding the ceramic 26.

Specimens like those in FIGS. 2 and 3 were made as follows. A piece of AISI 304 stainless steel, was cleaned with solvent and grit blasted in a conventional manner. The bond coat was a nickel chromium aluminun alloy powder sized $45\text{–}120\times10^{-6}$m, (Alloy 443, Metco, Inc, infra). The fibers were AISI 304 stainless steel, with a $0.25\times0.25$ mm square cross section and a length of about 30 mm. The ceramic powder was an admixture of 80% zirconia and 20% yttria, sized $10\text{–}90\times10^{-6}$m (Metco Material 202NS). For plasma spraying, a conventional gun and power supply were used, namely, a Metco Model 7M systems and gun with a style G tapered nozzle having a 7.8 mm exit dia. (Metco, Inc., Westbury, N.Y.). The gun was traversed across the flat worpiece at a rate of about 0.3 m/s, with each successive pass being offset about 3 mm from the preceding pass. Fibers were fed using a Thermal Arc P1-AOV-2 Feeder (Sylvester & Co., Cleveland, Ohio.) The fibers were injected into the plasma stream outside the nozzle, as more particularly described below. The powders were injected into the stream immediately downstream from the exit face of the conventional manner, with feed rates at about 0.05 g/s.

The bond coat was applied to a thickness of about 0.05–0.14 mm. Next the fibers were applied to the surface in a manner which caused them to adhere. When the fibers are injected, they are entrained in the plasma stream and impelled toward the workpiece. Only portions of the fibers are melted, and they adhere to the workpiece. The heat transfer, a function of plasma gas enthalpy and residence time in the stream, must be sufficient to melt a portion of the fibers, to cause them to adhere to the workpiece and to each other. However, the heat transfer must not be so high as to cause complete melting of the fibers, which because of surface tension forces, would cause them to be converted into droplets. For the 0.25 mm stainless steel fibers, a relatively high enthalpy was required to obtain the requisite melting. The technique is described in more detail below. The density of sprayed fibers was estimated to be in the range of 10–25% of the bulk metal density of 7.9 g/cc. Nominally it is characterized herein as being of about 15% density.

The ceramic powders were sprayed in a conventional manner, with the gun nozzle oriented 90 degrees to the substrate. Parameters for spraying the powders were conventional, generally comprising a gun to workpiece distance of about 64 mm, 700 amps, 70 volts, about 62 $cm^3/s$ nitrogen in combination with 9 $cm^3/s$ hydrogen. The same parameters were used for spraying the fibers, as described below. For the aforementioned nominal 15% fiber density, the ceramic penetrated through to the workpiece and gave a relatively uniform density. Usually, it is expectable that there will be some shielding of the areas underneath fibers which project across the plane of the workpiece. But this did not seem to cause significant voids in the particular example. If excessive shielding is encountered, then the gun may be inclined at varied oblique angles to the workpiece surface, to better deposit ceramic under the fibers, and obtain higher density. However, there will be a density of the fibers sufficiently high such that the ceramic will not be able to penetrate through, and lower density, or no density, can result. In special circumstances this may be desired.

In most instances, the ceramic will be able to penetrate the fiber layer. Thus, as described above, a polymer or other coating is used as a fugitive material, to produce an absence of ceramic matrix near the substrate surface when this is desired. In the example, the polyester (Metco 600 material), with particle size distribution between $44–106\times10^{-6}$m, was sprayed in a conventional mode to a thickness of about 0.25 mm. It was removed by furnace heating for 3 hr at 550° C. Other fugitive materials may be used, such as Lucite 4F acrylic resin (Dupont Co., Wilmington, Del.). Polymers are preferred because they may be removed easily by oxidation and moderate heating. Also usable will be soluble or meltable materials, such as salts, and other materials used to coat mandrels when free-standing structures are created by plasma coating.

The foregoing description is for a demonstration specimen. To make an actual ceramic airseal for a gas turbine engine, along the lines shown in U.S. Pat. No. 4,273,824, the substrate would be a nickel, iron or cobalt superalloy. The fibers would be a material with strength and corrosion resistance at high temperature. They may have a similar composition to the substrate, or another composition. One specific example of another useful high temperature fiber is Hoskins 875 alloy (by weight, 22.5 Cr, 5.5Al, 0.5Si, 01.C, balance Fe) produced by the Hoskins Manufacturing Co., Detroit, Mich., USA. In an airseal, the previously described zirconia base ceramic would be useful. Other ceramics which will be useful will be meltable refractory compounds of metals with melting points over 1400° C., preferably oxides, but also including borides, nitrides, carbides, as pure compounds or combinations. The spacing between the ceramic and the substrate, where there are only fibers, may be varied over the range of about 0.25–12 mm, by applying sufficient fibers and sufficient fugitive material. The thickness of the space having fibers only will depend on the particular application. Greater spacings will provide greater capability for absorbing thermal mis-match strains.

Figure 4:
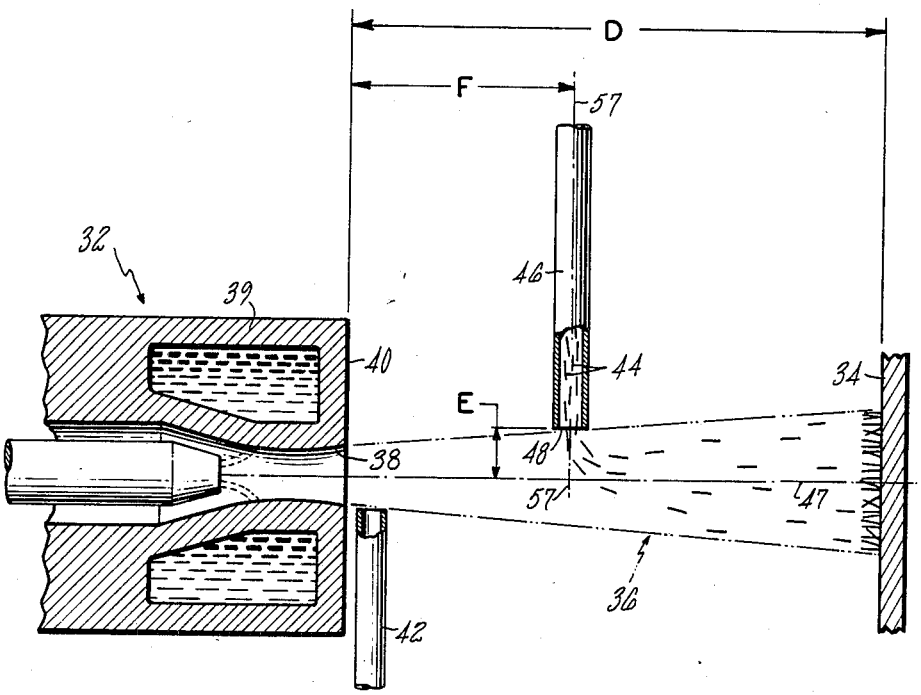
FIG. 4 shows the relationship of the plasma spraying apparatus and workpiece.

The manner in which the fibers are deposited on the substrate is illustrated in part by FIG. 4. A plasma gun 32 is positioned a distance D from a workpiece or substrate 34. The plasma gas stream 36 issues from the opening 38 of the nozzle 39. Immediately downstream, adjacent to the nozzle face 40, is the conventional powder injection conduit 42. Unlike powders, fibers 44 are injected by means of a separate conduit, tube 46, spaced a distance from the nozzle face. Tube 46 is preferably positioned normal to the centerline 47 of the plasma gas stream, although some inclination of the pipe toward the workpiece may be used. The pipe outlet 48, through which the fibers 44 exit, is spaced apart from the centerline of the plasma stream a distance E, sufficient to ensure that it will not be directly impacted by the stream. Fibers are conveyed through the tube 46 by a carrier gas; e. g., a flow of about 10 $cm^3/s$ was used to convey the aforementioned 0.25 mm stainless steel fibers through a 6 mm dia. tube 46. Upon exiting from the outlet 44 of the tube, the fibers become entrained in the gas stream.

The exact position of the fiber injection tube may be varied, dependent on the specific operating conditions, and fiber size and results desired. Generally, the tube axis 57 will approximately intersect the centerline 47 of the plasma stream. It is found that the point of injection of fibers preferably is located downstream from the point at which powders are ordinarily injected. This is reflective of the need for comparatively less heating of the fibers, relative to powders, to carry out the objects of the invention and have the fibers adhere to the workpiece with substantially an acicular configuration, as described further herein. By example, the aforementioned 0.25 mm dia. steel fibers were injected at a distance F of approximately 8 mm from the nozzle face when the nozzle face to workpiece distance D was about 64 mm. The spacing E, off the centerline 47 was about 6 mm.

In our practice of the invention, we vary the distance F at which the fibers are introduced, to control the precise degree of fiber melting which is needed. Generally, fibers in which less energy is needed for melting will be introduced at points closer to the workpiece surface. By following this practice, of varying the point of axial introduction, the plasma stream power level may be set more independently. Thus, high velocities associated with high power levels may be attained, but the fiber residence time will not be so great as to cause undue melting. Further, our approach enables the power setting of the gun to be set at that required by a powder being sprayed, thus facilitating practice of various embodiments of our invention, especially, that involving simultaneous introduction of powder and fibers. The fibers will be introduced at distances E which are within 5–80% of the nozzle face to workpiece surface distance D; preferably, the foregoing range will be 10–50%. This distance D will vary as it does for spraying powders. Generally it will be in the range 50–175 mm, depending on materials being sprayed, ambient environment, etc. Of course, if fibers are introduced too close to the workpiece surface there will be insufficient residence time in the stream to cause melting and obtain adherance of the fibers to the workpiece. ( In such circumstances, however, the fibers may still be included within a plasma coating if powders are impinged on the surface simultaneously).

Figure 5:
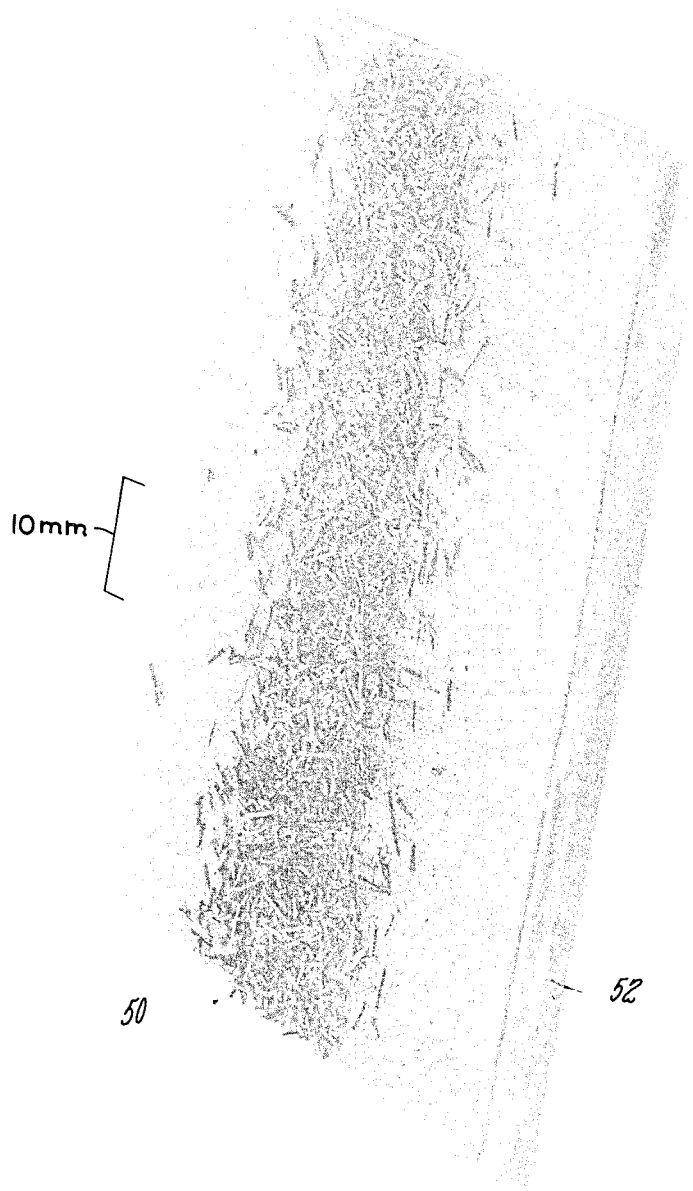
FIG. 5 is a photograph of sprayed copper fibers, adhered to a workpiece.
Figure 6:
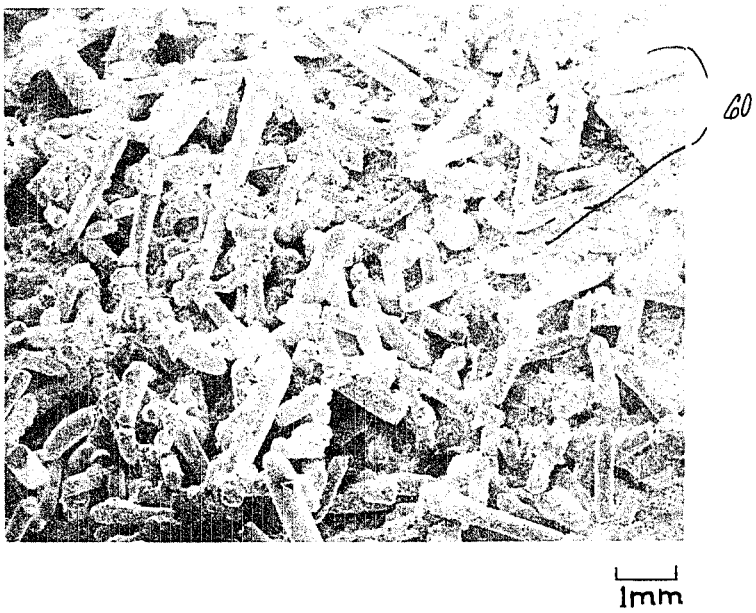
FIG. 6 is a higher magnification photograph of the fibers of FIG. 5.
Figure 7:
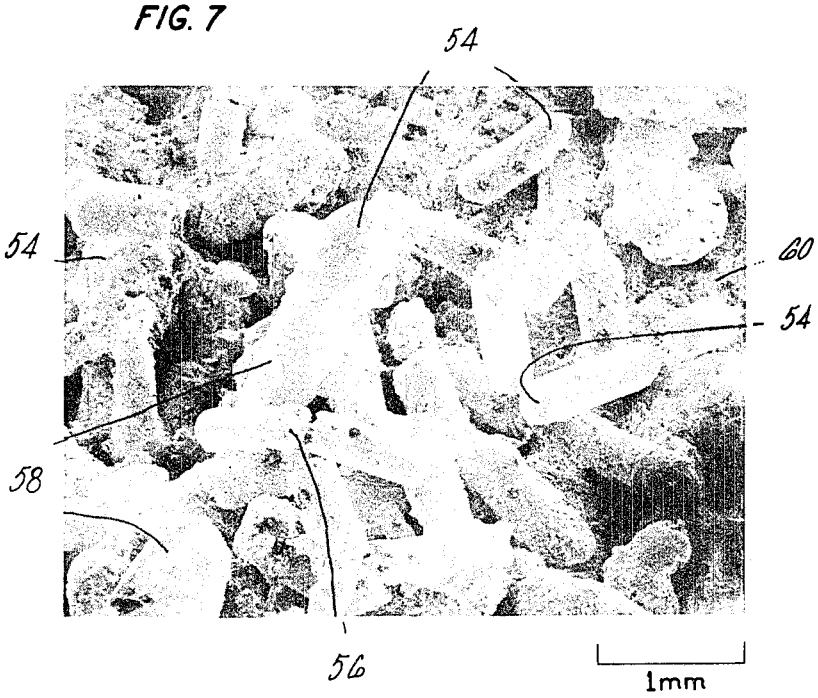
FIG. 7 is similar to FIG. 6, but at higher magnification.

Microscopic studies have been made of the fibers which are deposited on the workpiece. FIG. 5 shows 0.35 mm dia. by 3–6 mm long copper fibers deposited onto a Metco Alloy 443 coated workpiece. The fiber-density was estimated at about 40%. FIGS. 6 and 7 are higher magnification views from a 30 degree angle off surface perpendicular. It is seen from FIG. 5 that the fibers 50 have a variety of orientations with substantial numbers of the fibers projecting, at various angles approaching normal, up to 3 mm into space from the plane of the workpiece 52. This is in contrast to a 1.8 mm thick fiber mat which might be brazed on the workpiece in accord with the prior art in U. S. Pat. No. 4,273,824, where all the fibers would lie approximately parallel to the plane of the workpiece surface. FIGS. 6 and 7 show that portions 54 of the fibers are melted. Also seen is some fiber fracture 56 and oxidation scale 58. Some of the bond coated substrate surface 60 is visible. Mostly, the ends of the fibers are melted, and applying force to the fibers shows they are mostly bonded to the workpiece surface. There is also some surface melting along the length of the fibers, which provide bonding between the fibers where they contact one another. While some are broken and some excessively melted, the preponderance maintain an acicular shape, substantially of their original diameter.

In our practice of the invention thus far, we have utilized metal fibers. Basically, these have been chopped up pieces of commercial wrought wire or pieces of foil which have been slit to very narrow widths (which results in a fiber with essentially a square or rectangular cross section). When we refer herein to the diameter of our fiber, for non-circular cross section fibers, we mean the diameter of the mean circle which fits within the non-circular cross section. Presently, we believe that the diameters between about 0.05 and 0.35 mm to be useful with conventional plasma spray equipment. As pointed out earlier, the minimum fiber diameter will be determined by the minimum plasma gun heat transfer conditions which result in an effective coating. When we sprayed 0.01 mm dia. fibers, it was not possible to avoid entirely melting them with our equipment. The maximum diameter will be a function of heat transfer condition also, especially the residence time of the fiber in the plasma stream before it contacts the workpiece. To obtain uniform results, the fibers should be of substantially uniform diameters. If undersize fibers are included, they are likely to melt; too many would defeat the objects of the invention. However, the fibers within a lot may vary in length, since this parameter will not substantially affect the results, except regarding the orientation, as discussed elsewhere.

Preferably the fibers will be incorporated into the matrix in a manner which provides the strengthening or property improvement most desired. For strength, it is generally known that a major limitation of plasma coatings is their bonding to the substrate. The invention as described above, where the fibers are attached to both the substrate and the matrix, provides an improvement in this respect. Plasma coatings are deposited in successive passes, and thus are characterizable as layers of solidified particles. There is a propensity for failure between the layers, and thus when the fibers are incorporated so that they project through the layers, strengthening is provided. Typically, a layer may have a thickness of the order of 0.08 mm, and thus a fiber would project through at least half of two such abutting layers, for a total fiber length of about 0.08 mm, to provide a benefit. To strengthen a layered matrix, the fibers must be adequately bonded to the matrix. The fiber length along which bonding must be present to strengthen the matrix is a function of the shear strength of the bond. This will vary with the composition of the fiber and matrix, but generally, we believe that a fiber must be bonded along a length equal to about three fiber diameters to provide adequate strength. Thus, for this application, the minimum fiber aspect ratio would be 6:1.

The aspect ratio, the (ratio of the length to the nominal diameter of the fiber) is an important parameter. First, it affects the pattern which the fibers form when they adhere to the workpiece. Based on limited observation, it appears that if fibers have high aspect ratios, e. g., about 20:1 for 0.25 mm dia. stainless steel fibers, they will tend to be deposited in a random orientation fashion. However, when the aspect ratio of such fibers is less than about 15:1, they tend to be deposited in a more aligned pattern, that is, more nearly normal to the surface of the workpiece. Thus when one orientation or the other is preferred, the fiber aspect ratio would be selected accordingly. It is not fully understood why the foregoing effects are observed. But, it is believed that all fibers tend to become aligned parallel to the flow direction of the plasma gas stream. However, when they impact the workpiece the longer fibers will tend to bend over more, and thus become more randomly oriented.

When fibers are too long, difficulty will be encountered in feeding them. This, of course, depends on the powder feeding device and the size of the nozzle, etc. For most applications we believe that the useful lengths of fibers will range between about 0.1–4 mm. Following along the lines of the discussion above, the aspect ratio preferably will range from about 3:1 to 80:1. The foregoing ranges may change with further development.

The density of the fibers which are deposited prior to the matrix may be varied by selection of parameters, especially fiber size, feed rate, carrier gas flow, and stream conditions. Generally, for fibers deposited independently, the bulk density will range up to 60% of the solid metal density. The density of articles comprised of deposited fibers and subsequently sprayed matrix will depend on the degree to which the matrix is able to penetrate the fibers. (Of course the matrix will have an inherent density of its own, irrespective of the presence of fibers.) Because our fibers tend to be oriented in more nearly normal orientation, higher matrix-fiber composite density can be obtained, compared to fiber mats in previous use, such as described in U. S. Pat. No. 4,273,824. Based on limited evidence, for fiber deposits such as shown in FIG. 3, we are able to get approximately normal matrix density where fiber densities range up to about 50%.

We have mentioned the use of a bonding coat at various points herein. Conventional plasma coating underlayer materials such as nichrome, nickel aluminum, and the like will be found useful. They will be deposited on the workpiece, in the manner which is well known as being used for improving the adherence of conventional plasma coatings. When the bonding coat is applied to the surface of fibers already deposited, or contemporaneously with them, the quantity which will be deposited will be that which would produce a coating of about 0.08 mm thick on a flat workpiece, were the fibers not present. Too great a deposit would instead convert the bonding coat into a matrix.

While we contemplate that the major utility of our invention will be to strengthen ceramic and other brittle coatings, we believe that further work will demonstrate other improved materials. Thus, it is within our contemplation that the invention will be useful with all kinds of plasma coatings.

An example of a plasma coating which can especially benefit from the inclusion of metal fibers is a porous (40% density) metal coating, used as a relatively soft abradable material, such as is made by spraying in combination a polymer and nichrome powder, and subsequently removing the polymer. By including nichrome fibers in the porous nichrome matrix, thermal conductivity of the metal article will be enhanced. In such instances, the degree of bonding between fiber and matrix is of less importance, but it is desired that the fibers be aligned to the best degree possible, along the direction in which the heat transfer is desired. One application for such a material would be as an abradable seal used in the compressor of a gas turbine. Heat will be transferred from a local rub spot to adjacent areas of the seal, minimizing localized heating which might degrade the seal or the structure with which it interacts. While we believe the major initial use of our invention will be as an improvement for supplanting fiber mats, in certain instances, our techniques will enable a direct substitution for fiber mats. To do so, we would plasma spray using fibers and parameters which tended to give a fiber orientation parallel to the surface. A hot or cold pressing step may be subsequently used to deform the fibers after deposition, to cause them to become more nearly parallel to the surface.

It is well known that plasma coatings can be used for forming free-standing articles, such as crucibles, rocket nozzles, and the like. Our fiber spraying techniques may be used to improve the properties of such articles, in accord with the foregoing embodiments of the invention.

Further, we believe that our method of spraying fibers and adhering them to a metal surface may be useful to hold and strengthen other coatings than plasma coatings such as polymers, vapor depositions, electroless coatings, etc. It is also within contemplation that fibers alone adhered to workpiece surfaces as shown in FIG. 1(*b*), will provide desirable high surface areas in electrical and chemical applications, or would be useful as abradable materials in gas turbines.

We have described the best present mode of our invention, but other refinements are exprected to improve its practice. We have used plasma arc spraying because it is an advanced method. But other thermal spraying processes, such as those which use products of combustion or heat sources other than electric arcs, may suitably melt the fibers and can be used to practice the invention.

Separate guns may be used for spraying the fibers and the powders when they are to be sprayed simultaneously, to enable independent control of the parameters for each material. As another alternative, a single gun with a single powder/fiber injection port might be used, where the fibers and powders are mixed together. This would require experiment to determine the compatibility of the parameters with the selected sizes of powders and fibers, and the point of introduction.

Although this invention has been shown and described with respect to a preferred embodiment, it will be understood by those skilled in the art that various changes in form and detail thereof may be made without departing from the spirit and scope of the claimed invention.

We claim:

1. An article comprising a substrate having a surface to which are adhered a multiplicity of fibers, the fibers having been partially melted during thermal spraying thereof onto the surface, the fibers bonded to the surface by the portions thereof which have been melted; and, matrix material spaced apart from the surface of the substrate to provide a gap between the matrix and the surface.

2. The article of claim 1 characterized by a metal substrate, metal fibers and a ceramic matrix.

3. The article of claim 1 having a gap spacing of 0.25–12 mm.

4. The article of claim 1 characterized by fibers having a length-to-diameter ratio of between 6:1 and 15:1.

5. The article of claim 1 characterized by fibers of 0.1–4 mm length having length-to-diameter ratios between 3:1 and 80:1.

6. An article comprising a substrate having a surface to which are adhered a multiplicity of fibers, the fibers having been partially melted during thermal spraying of the fibers onto the surface, the fibers bonded to the surface by portions thereof which have been melted; and a layered plasma sprayed matrix material enveloping the fibers, the fibers projecting transverse to the layers of the plasma sprayed matrix material and having on their surfaces a bond coat.

7. An article comprising a substrate having adhered to its surface a multiplicity of metal fibers, the fibers having been injected into a thermal spraying device and portions surfaces of the fibers having been melted during thermal spraying thereof onto the surface, the fibers bonded to each other and to the substrate surface by the melted portions which have solidified.

8. The article of claim 7 further characterized by a matrix material enveloping the fibers.

9. The article of claim 7 further characterized by a matrix material comprised of layered plasma sprayed particles.

10. The article of claim 7 further characterized by fibers projecting transverse to the layers of the plasma coating.

11. The article of claim 7 further characterized by metal alloy fibers adhered to a metal alloy substrate and a ceramic matrix material.

12. The article of claim 7 characterized by fibers having a length-to-diameter ratio of between 6:1 and 15:1.

13. The article of claim 7 characterized by fibers of 0.1–4 mm length having length-to-diameter ratios between 3:1 and 80:1.

14. The article of claim 7 wherein the portion of the article which comprises the multiplicity of fibers has a density of 10–25% of the bulk density of the metal of the fibers.

15. The article of claim 7 wherein the fibers are composed of a single material.

16. The article of claim 15 further characterized by a matrix material enveloping the fibers.

17. The article of claim 15 further characterized by a matrix material comprised of layered plasma sprayed particles.

18. The article of claim 15 further characterized by fibers projecting transverse to the layers of the plasma coating.

19. The article of claim 15 further characterized by metal alloy fibers adhered to a metal alloy substrate and a ceramic matrix material.

20. The article of claim 15 characterized by fibers having a length-to-diameter ratio of between 6:1 and 15:1.

21. The article of claim 15 characterized by fibers of 0.1–4 mm length having length-to-diameter ratios between 3:1 and 80:1.

* * * * *